US007333078B2

(12) United States Patent
Lai et al.

(10) Patent No.: US 7,333,078 B2
(45) Date of Patent: Feb. 19, 2008

(54) DRIVING SYSTEM AND METHOD FOR ELECTROLUMINESCENCE DISPLAYS

(75) Inventors: Wai-Yan Stephen Lai, Hong Kong (HK); Chung Yee Ricky Ng, Hong Kong (HK); Wai Yu Wong, Hong Kong (HK)

(73) Assignee: Solomon Systech Limited, New Territories (HK)

( * ) Notice: Subject to any disclaimer, the term of this patent is extended or adjusted under 35 U.S.C. 154(b) by 645 days.

(21) Appl. No.: 10/746,559

(22) Filed: Dec. 29, 2003

(65) Prior Publication Data

US 2005/0146489 A1 Jul. 7, 2005

(51) Int. Cl.
*G09G 3/30* (2006.01)

(52) U.S. Cl. ..... 345/76; 345/205; 345/211

(58) Field of Classification Search ..... 345/76–80, 345/82, 204–206, 211–215
See application file for complete search history.

(56) References Cited

U.S. PATENT DOCUMENTS

| | | | | |
|---|---|---|---|---|
| 6,501,226 | B2 | 12/2002 | Lai et al. | |
| 6,534,925 | B2 | 3/2003 | Kawashima | |
| 6,714,177 | B1 * | 3/2004 | Ishizuka | 345/76 |
| 6,914,388 | B2 * | 7/2005 | Shin et al. | 315/169.2 |
| 6,975,290 | B2 | 12/2005 | Asano | |
| 7,088,317 | B2 | 8/2006 | Ohshita et al. | |
| 7,119,768 | B2 * | 10/2006 | Yazawa et al. | 345/76 |
| 2002/0101179 | A1 | 8/2002 | Kawashima | |
| 2003/0001828 | A1 | 1/2003 | Asano | |
| 2003/0184503 | A1 | 10/2003 | Ohshita et al. | |

FOREIGN PATENT DOCUMENTS

| | | |
|---|---|---|
| TW | 529004 | 4/2003 |
| TW | 563078 | 11/2003 |
| TW | 589601 | 6/2004 |
| TW | 591574 | 6/2004 |

* cited by examiner

*Primary Examiner*—Amr A. Awad
*Assistant Examiner*—Tom V Sheng
(74) *Attorney, Agent, or Firm*—Finnegan, Henderson, Farabow, Garrett & Dunner LLP

(57) ABSTRACT

A driving system and method for electroluminescence displays having a matrix of electroluminescence elements arrayed in rows and columns with a control circuit for discharging each anode line to a column equalization bus (CEB), includes connecting the charged anode line to the CEB at the end of activation of each anode line. Discharging and subsequent de-activation of the anode line are allowed by charge-sharing with un-activated anode lines that are to be activated for the next row. This is accomplished by connecting the charged anode line to the CEB. In displaying images, anode lines are activated for a number of time periods according to gray scale or color data. Anode lines are consequently de-activated accordingly at different times during a lighting phase for each row display time. When anode lines are discharged through charge sharing on the CEB, a control circuit maintains the voltage on the CEB below a level that may cause inadvertent activation of the de-activated elements.

19 Claims, 5 Drawing Sheets

DRIVING SYSTEM AND METHOD FOR ELECTROLUMINESCENCE DISPLAYS

DESCRIPTION OF THE INVENTION

1. Field of the Invention

The present invention generally relates to electroluminescence displays and, more particularly, to a driving system and method for an electroluminescence display.

2. Background of the Invention

An electroluminescence display includes a panel of electroluminescence elements organized in a two-dimensional (2-D) matrix of rows and columns. Each of the electroluminescence elements of the display further includes two electrodes of the opposite electric polarity, i.e., an anode and a cathode. One of the electrodes is connected to a row line while the other is connected to a column line of driving circuitry of a driving system for the display. Each of the electroluminescence elements in the matrix is located where the addressing row and column lines for that particular element intersect.

An electroluminescence element emits light when it conducts electric current. This occurs when a voltage across the anode and cathode of the element is applied with in the forward polarity, i.e., a positive voltage to the anode and a negative voltage to the cathode. Intensity of the emitted light is determined by the magnitude of the current, which, in turn, is dependent on the magnitude of the voltage applied across the electrodes.

In driving the electroluminescence display, each row and/or column of the elements in the matrix is sequentially activated one at a time in a scanning manner. While each row or column is activated, selected elements in the activated row or column are turned on through established electric routes to a power source of the drive system for energizing to emit light. The addressed elements are sequentially activated in repeated scanning cycles at sufficient speed so that the sequentially emitting elements appear to the human eye as being lighted simultaneously.

Row scanning is used in the art to drive electroluminescence displays, where display element rows in the matrix are sequentially addressed. Meanwhile, appropriate power or ground sources drive the element columns so as to selectively activate or deactivate the electroluminescence elements in accordance with requirements of the image data to be displayed.

U.S. Pat. No. 6,501,226 (the "'226 patent"), assigned to Solomon Systech Ltd. of Hong Kong and sharing common inventorship with the present patent application, illustrates and describes a prior art system and method for driving an electroluminescence display panel. The display panel according to the '226 patent such as shown in FIG. 4 thereof includes a matrix of 64 rows and 132 columns of display elements. Each of the display elements is designated $E_{C,R}$ where "C" identifies the column and "R" the row. In the matrix consisting of $E_{1.1}$ through $E_{132.64}$ in its entirety, anodes of each column of the prior art panel are electrically connected together and to their respective anode lines $A_1$ through $A_{132}$. Similarly, cathodes of each row of elements are connected to their respective cathode lines $B_1$ through $B_{64}$. For scanning, the top row with electroluminescence elements connected to the cathode line B1 is activated by connection to ground through an assigned cathode line scanning switch $\mathbf{5}_1$ of a cathode line scanning circuit 1. At the same time, all other elements in cathode lines $B_2$ through $B_{64}$ remain de-activated by connection to power $V_{CC}$ through their respective cathode line scanning switches $\mathbf{5}_2$ through $\mathbf{5}_{64}$. Cathode line scanning circuit 1 is essentially an array of switches for connecting the rows of display elements alternatively to the power and ground voltages. An anode line driving circuit 2, essentially an array of switches for connecting the columns of display elements to the power source, activates selected columns of elements by connecting them to their respectively assigned current sources among the current sources $\mathbf{2}_1$ through $\mathbf{2}_{132}$. Columns to be de-activated are instead connected to ground through anode line resetting switches $\mathbf{7}_1$ through $\mathbf{7}_{132}$ in an anode line resetting circuit 3, which is an array of switches for selectively connecting the columns to ground.

In electroluminescence displays, parasitic capacitance inherent in the display elements can adversely affect operation. Due to large capacitive loading on the lines as well as the effect of charge storage, quality of displayed images can deteriorate when light emission time for one or more elements becomes non-uniform in the repeated frame cycles for different image patterns. When off elements are induced to emit light due to signal cross-coupling under large capacitance load switching conditions, display quality can also be degraded. In addition, the large panel capacitances are charged and discharged by supplying large switching currents from the power sources. These switching currents proportionally increase with panel size and with scan speed. As the switching currents increase in magnitude, noise may become undesirably large and adversely affect operation.

There is thus a general need in the art for a system and method for driving electroluminescence displays that can overcome the aforementioned shortcomings in the art. A particular need exists in the art for a driving system and method that can improve display quality, loading and noise difficulties.

SUMMARY OF THE INVENTION

Accordingly, the present invention is directed to a system and method for driving electroluminescence displays that obviate one or more of the problems due to limitations and disadvantages of the related art.

To achieve these and other advantages, and in accordance with the purpose of the invention as embodied and broadly described, there is provided a column discharge system and method for driving electroluminescence displays.

According to an embodiment of the present invention, an electroluminescence display is provided with a matrix of electroluminescence elements arrayed in rows and columns. The anodes of the electroluminescence elements on each row are electrically connected to a corresponding anode line, whereas the cathodes of the electroluminescence elements on each column are electrically connected to a corresponding cathode line. The driving system according to the present invention further comprises a control circuit for discharging each anode line to a CEB. Each anode line is discharged at the end of each line's activation of the electroluminescence display.

At the end of activation of each anode line, the charged anode line is connected to the CEB. Discharging and subsequent de-activation of the anode line are allowed by charge-sharing with un-activated anode lines that are to be activated for the next row. This is accomplished by connecting the charged anode line to the CEB.

In displaying images with gray scale or color data, anode lines are activated for a number of time periods according to the gray scale or color data. Anode lines are consequently de-activated accordingly at different times during the lighting phase for each row display time. When anode lines are accordingly being discharged through charge sharing on the CEB, the control circuit according to the present invention keeps the voltage on the CEB from reaching a level that may cause inadvertent activation of the de-activated elements.

An exemplary display system according to an embodiment of the present invention will thus comprise a matrix of electroluminescence elements arrayed in a plurality of rows and columns, a plurality of cathodes and anodes respectively corresponding to the electroluminescence elements, a plurality of cathode lines electrically connected to the cathodes on the rows in the matrix, a plurality of anode lines electrically connected to the anodes on the columns in the matrix, a control circuit lighting at least one of the electroluminescence elements for display through an electrical route across a power source and ground, and a CEB electrically connected to the anode lines.

In one aspect, the control circuit according to the present invention dynamically controls the bus voltage across the CEB. In an embodiment, the CEB is connected to a regulated voltage driver. In another aspect, depending on the driving phases, the control circuit actively maintains the CEB voltage at a selected voltage level, clamps the CEB voltage below a certain voltage level, electrically isolates the CEB, or performs a combination of control tasks of the above.

In yet another aspect, the display system according to the present invention includes a gray scale or color display. The display system according to another embodiment of the present invention can also include an organic light emitting device (OLED) or a polymer electroluminescence device (PELD).

In still another aspect, the present invention provides a driving system for an electroluminescence display having a matrix of electroluminescence elements arrayed in a plurality of rows and columns and a plurality of cathodes and anodes respectively corresponding to the electroluminescence elements. According to an embodiment, the driving system comprises a plurality of cathode lines electrically connected to the cathodes on the rows in the matrix, a plurality of anode lines electrically connected to the anodes on the columns in the matrix, a control circuit lighting at least one of the electroluminescence elements for display through an electrical route across a power source and ground, a CEB electrically connected to the anode lines. The control circuit in the driving system dynamically controls the bus voltage across the CEB. In an embodiment of the driving system according to the present invention, the CEB is connected to a regulated voltage driver. Depending on the driving phases, the control circuit actively maintains the CEB voltage at a selected voltage level, clamps the CEB voltage below a certain voltage level, electrically isolates the CEB, or performs a combination of control tasks of the above.

The present invention accordingly provides a method for driving an electroluminescence display having a matrix of electroluminescence elements arrayed in a plurality of rows and columns, a plurality of cathodes and anodes corresponding to the electroluminescence elements. The driving method according to an embodiment of the present invention will include the steps of electrically connecting a plurality of cathode lines to the cathodes on the rows in the matrix, electrically connecting a plurality of anode lines to the anodes on the columns in the matrix, activating at least one of the anode lines, de-activating at least one of the anode lines, charge sharing the activated anode lines with the de-activated anode lines.

In one aspect, as the cathode lines are sequentially scanned, the anode lines are activated and de-activated for time periods according to gray scale or color display data input into the electroluminescence elements.

In another aspect of the column voltage equalization according to the present invention, electrical charges in the electroluminescence elements in the anode lines are equalized. The anode lines are electrically discharged to a CEB.

In yet another aspect, the voltage on the CEB is dynamically controlled, e.g., by a control circuit. An exemplary display system is driven in a plurality of driving phases including a scanning phase, equalization phase and transition phase. Depending on the driving phases, the CEB voltage is actively maintained at a selected voltage level or clamped below a certain voltage level, or the CEB itself is electrically isolated, or a combination thereof.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawing, which is incorporated in and constitutes a part of this specification, illustrates several embodiments of the invention and together with the description, serves to explain the principles of the invention.

DESCRIPTION OF THE EMBODIMENTS

Figure 1A:
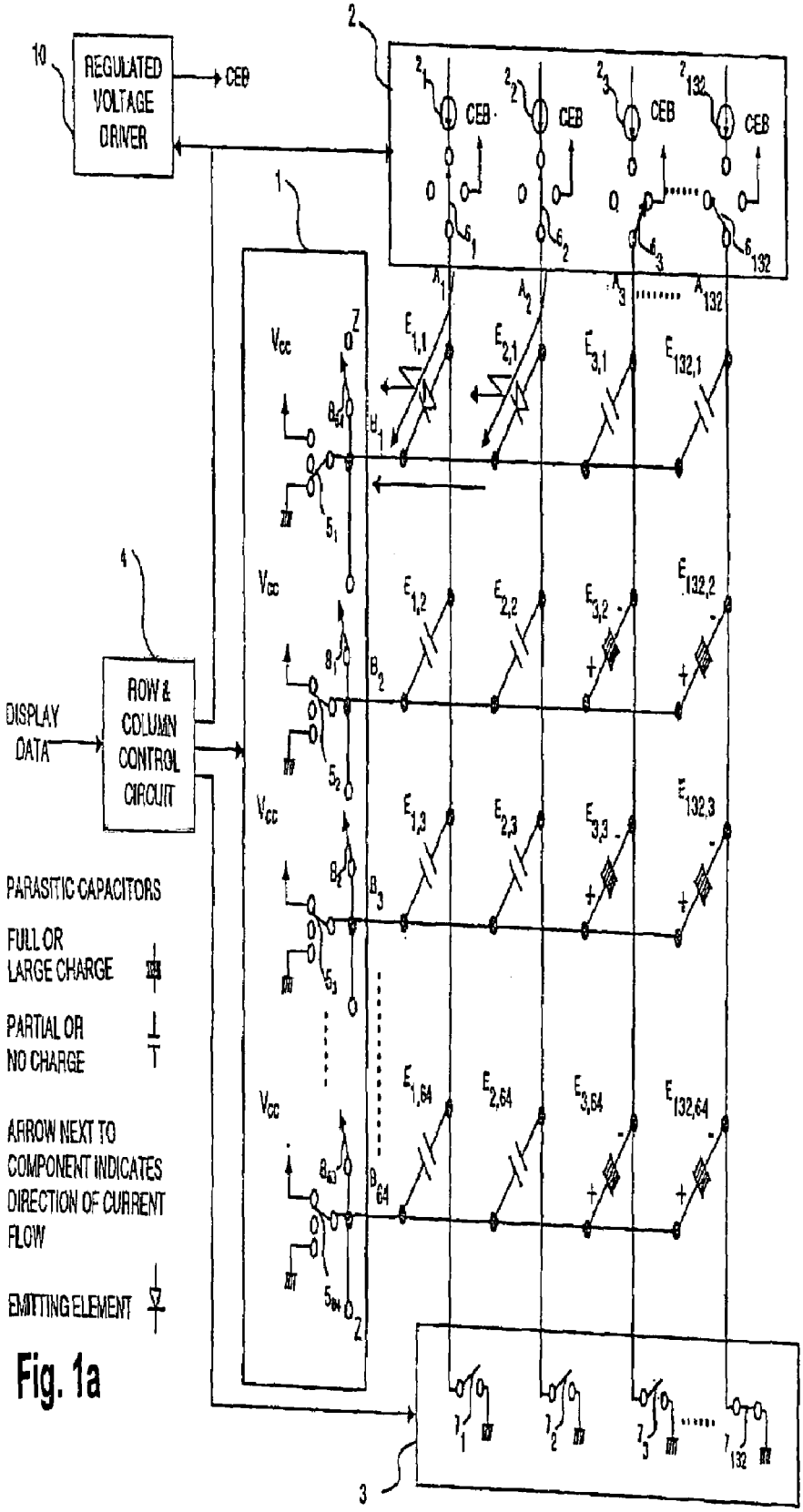
FIGS. 1*a*, 1*b*, 2, 3 and 4 are diagrams of an electroluminescence display having a driving system according to an embodiment of the present invention, respectively illustrated in depicting the different phases of operation in which column equalization is applied.

Reference will now be made in detail to embodiments of the invention, an example of which is illustrated in the accompanying drawings. Wherever possible, the same reference numbers will be used throughout the drawings to refer to the same or like parts.

FIGS. 1*a*, 1*b*, 2, 3 and 4 are diagrams of an electroluminescence display having the driving system according to an embodiment of the present invention. The electroluminescence display includes a panel having a matrix of 64 rows and 132 columns of display elements. The matrix is composed of elements $E_{1.1}$, through $E_{132.64}$. Anodes of each column of the panel are electrically connected together and to their respective anode lines $A_1$ through $A_{132}$. Similarly, cathodes of each row of the elements are connected to their respective cathode lines $B_1$ through $B_{64}$.

Driving of the electroluminescence display, as each activated anode line reaches the end of activation, the anode line is first disconnected from the driving source, and then connected to a column equalization bus (CEB) together with other un-activated anode lines that are to be activated for the next row. The anode line is then discharged and subsequently de-activated by charge sharing with the un-activated anode lines. During the entire time when anode lines are being discharged through charge sharing on the CEB, the control circuit keeps the voltage on the CEB from reaching a level that may cause inadvertent activation of the on-bus elements that should be inactive.

A regulated voltage driver is provided for the CEB. The regulated voltage driver actively maintains a selected bus voltage level, clamps the CEB voltage below a particularly selected level, and electrically isolates the CEB in facilitating charge sharing and conservation over the duration of the driving phases. In meeting the variations of electrical characteristics of the electroluminescence elements in different types of display panels, the functions of the regulated voltage driver and the CEB voltage levels are programmable under logic control in order to optimize the column equalization process for charge conservation and accurate image display.

In addition, the regulated voltage driver is dynamically optimized with the result of maintaining the CEB line voltage in different ranges at different times. For instance, in a lighting phase for the electroluminescence elements, the CEB line voltage level is maintained at or clamped at a voltage sufficiently low to keep the un-activated electroluminescence elements on the CEB inactive. In a row equalization phase, the CEB line voltage is allowed to float higher, up to a level not much higher than the equalized voltage of the rows undergoing charge sharing, thus maintaining all electroluminescence elements on the CEB inactive. In a scanned-row transition phase, the CEB line voltage is driven higher to a desired activation electric potential in a short transition time so that the elements to be energized will start to emit light at the desired intensity. This advantageously implements the voltage drive for the anode lines without the need for specifically made voltage drive switches in individual anode lines.

Correspondingly, methods for driving an electroluminescence display consistent with the present invention having a matrix of electroluminescence elements arrayed in a plurality of rows and columns, a plurality of cathodes and anodes corresponding to the electroluminescence elements are also provided. A driving method according to an embodiment of the present invention includes electrically connecting a plurality of cathode lines to the cathodes on the rows in the matrix, electrically connecting a plurality of anode lines to the anodes on the columns in the matrix, activating at least one of the anode lines, de-activating at least one of the anode lines, and charge sharing the activated anode lines with the de-activated anode lines.

In one aspect, as the cathode lines are sequentially scanned, the anode lines are activated and de-activated for time periods according to gray scale or color display data input into the electroluminescence elements.

In another aspect, column voltage equalization is provided for equalizing electrical charges in the electroluminescence elements in the anode lines. The anode lines are electrically discharged to a column equalization bus (CEB).

In yet another aspect, the voltage on the CEB is dynamically controlled, e.g., by a control circuit. An exemplary display system is driven in a plurality of driving phases including a scanning phase, equalization phase, and transition phase. Depending on the driving phases, the CEB voltage is actively maintained at a selected voltage level or clamped below a certain voltage level, or the CEB itself is electrically isolated, or a combination thereof.

Figure 1B:
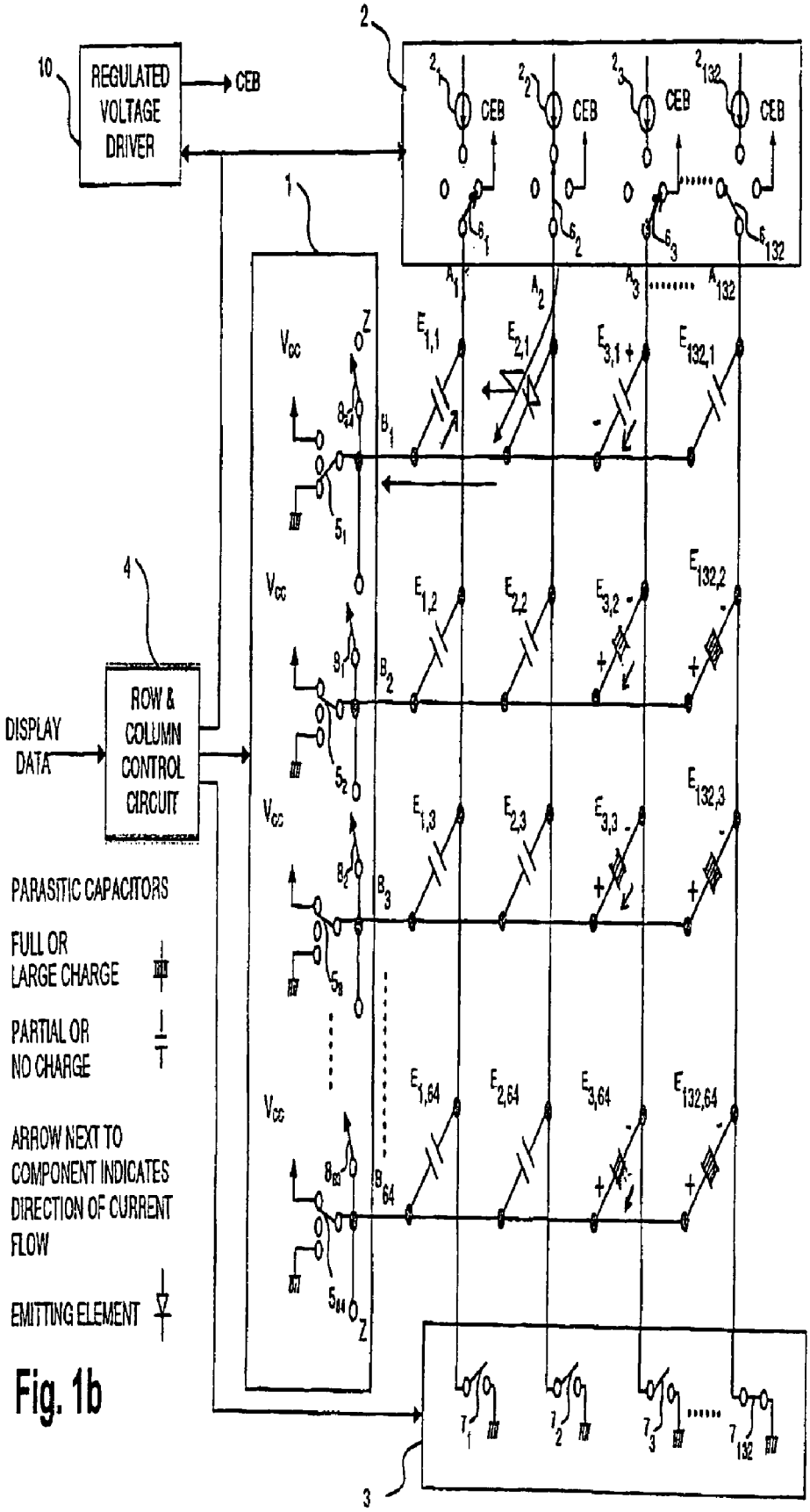

FIG. 1*a* and FIG. 1*b* illustrate a scanned-row lighting phase of the electroluminescence display. In the lighting phase, anode lines are activated for a number of time periods according to gray scale or color display data, and are consequently de-activated accordingly at different times in the lighting phase for each row display time. In the beginning of the lighting phase (FIG. 1*a*), anode line driving switches such as switch $\mathbf{6}_3$ connect the un-activated and discharged columns such as column $A_3$ to the CEB. According to the display data, column $A_3$ is the anode line for element $E_{3,2}$, which is to be activated at the next row. When the lighting phase for the individual anode line ends (FIG. 1*b*), driving switches such as switch $\mathbf{6}_1$ connect the previously activated columns, such as column $A_1$, to the CEB for electrical discharge by charge sharing and voltage equalization. A globally regulated voltage source maintains the column equalization voltage at a level sufficiently low to effectively turn off the electroluminescence elements such as $E_{1,1}$ that were previously emitting light. In the meantime, switches such as switches $\mathbf{7}_1$ and $\mathbf{7}_3$ remain open-circuited in order to allow the columns on anode lines $A_1$ and $A_3$ to be connected to the CEB to effect column equalization. In performing the column equalization consistent with the present invention, the residual voltages in the electroluminescence elements are equalized through the connection to the CEB. Undesirable effects in the display elements such as non-uniformity and cross talk are advantageously avoided as a result. During the time when the anode lines are being discharged through charge sharing on the CEB, the control circuit consistent with the present invention keeps the voltage on the CEB from reaching a level that may cause the de-activated electroluminescence elements to be activated.

Figure 2:
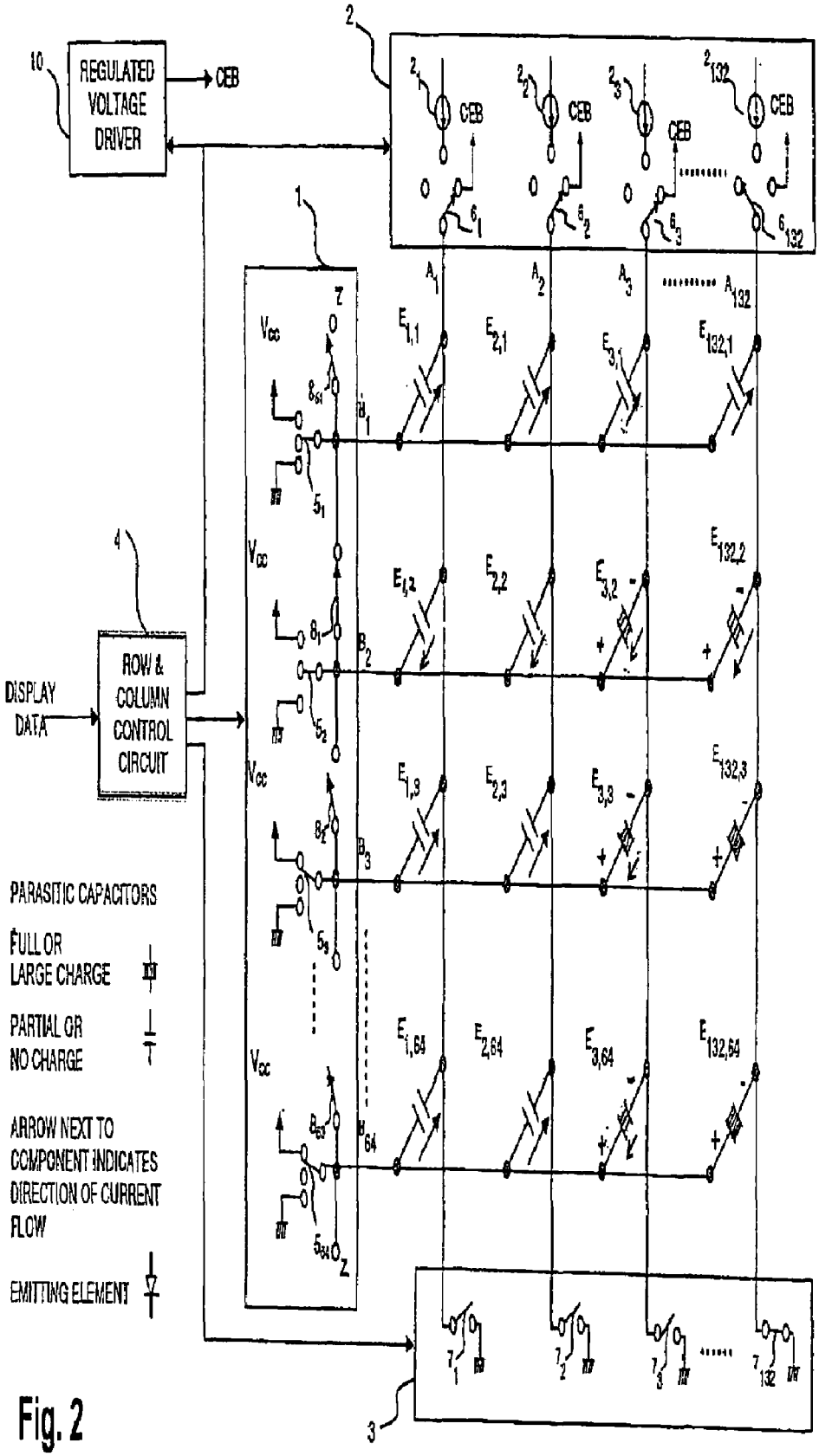

FIG. 2 is a diagram illustrating a row and column equalization phase in driving the electroluminescence display after a scanned-row lighting phase has concluded. The lighting phase constitutes the longest duration that an anode line can be activated during the period of a single row of display time, and thus the longest period corresponding to the highest brightness of a lighted element. At the end of the lighting phase, all of the remaining activated columns are to be de-activated by connecting them to the CEB for electrical discharge. Anode line driving switches such as $\mathbf{6}_2$ connected the remaining activated columns such as $A_2$ to the CEB for charge sharing and voltage equalization. A globally regulated voltage source maintains the column equalization voltage at a level sufficiently low to effectively turn off the electroluminescence elements such as element $E_{2,1}$ that were previously emitting light. A desirable level for the CEB voltage will be different from and higher than that in the lighting phase, since row equalization is concurrently implemented in the equalization phase. All switches such as switches $\mathbf{7}_1$, $\mathbf{7}_2$ and $\mathbf{7}_3$ are maintained open-circuited in order to allow all columns on all anode lines to be connected to the CEB to effect column equalization. In performing column equalization consistent with the present invention, residual voltages in the electroluminescence elements are equalized through the connection to the CEB. In the equalization phase, the row equalization takes place generally concurrently with the final column equalization process.

Figure 3:
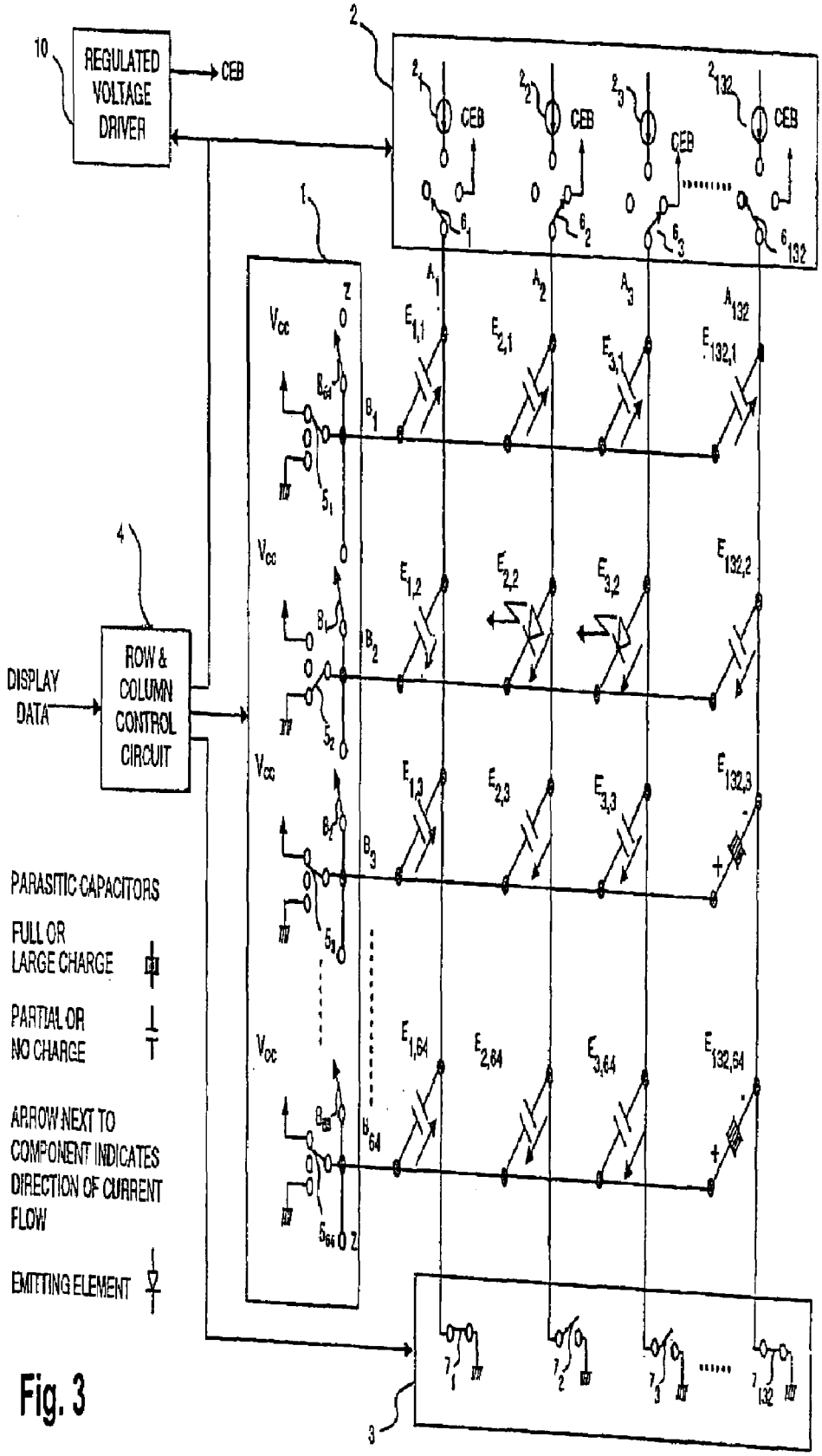

FIG. 3 is a diagram illustrating a scanned-row transition phase in driving the electroluminescence display after a row and column equalization phase has concluded. As the row and column equalization phase concludes, anode line driving switches, e.g., switch $\mathbf{6}_1$, and others connect to ground voltage the electroluminescence elements in the column on anode line $A_1$ and those columns not to be activated. In the meantime, the CEB brings the columns to be activated, for example, columns $A_2$ and $A_3$, to the required activation voltage potential so that electroluminescence elements, for example elements $E_{2,2}$ and $E_{3,2}$, can be energized and emit light when a row scan line, for example line $B_2$, is activated as cathode line scanning switches, for example switch $5_2$, connect the row of elements $E_{1,2}$ and $E_{B2,2}$ to ground after row equalization.

Figure 4:
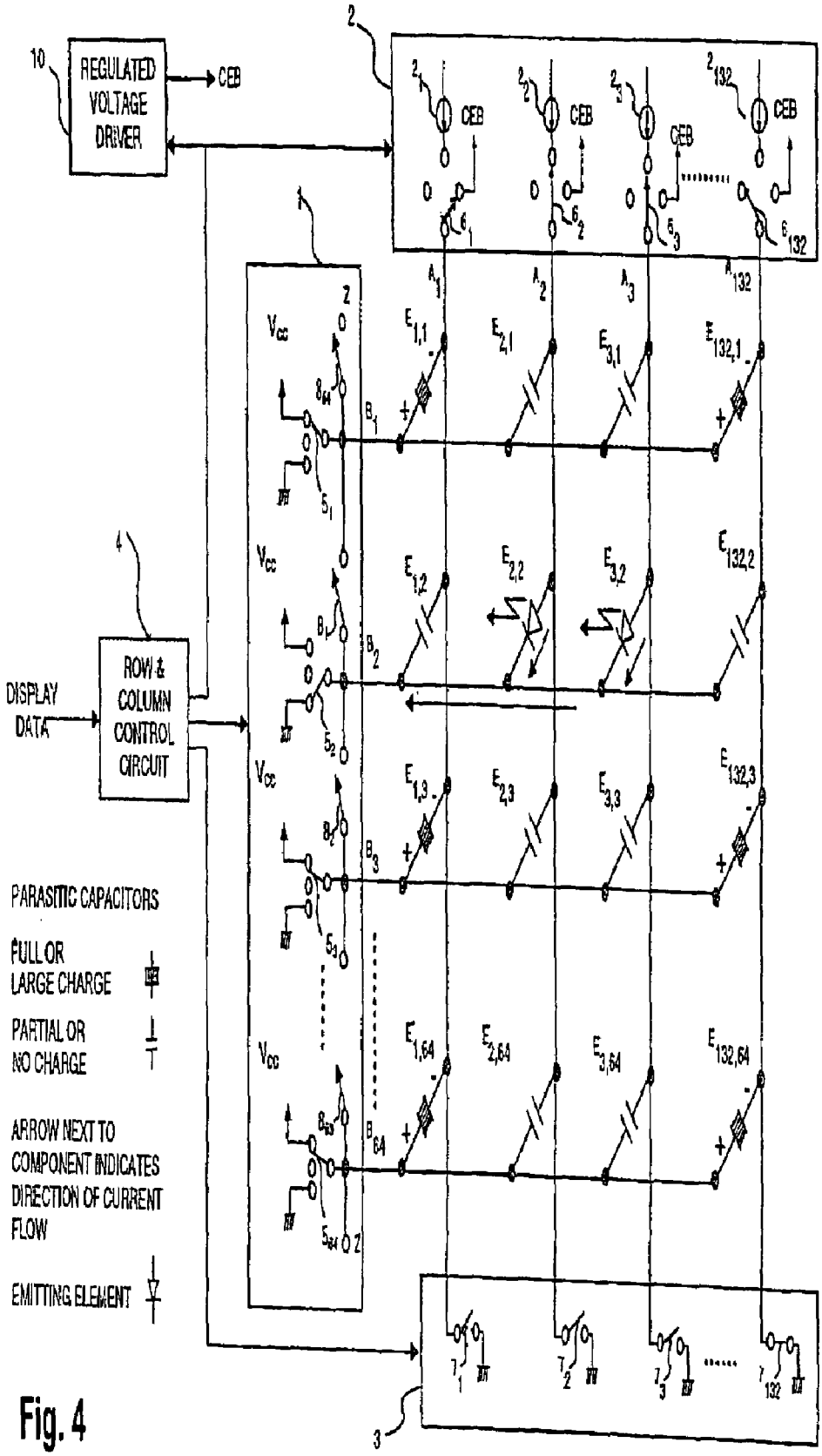

FIG. 4 is a diagram illustrating another stage of the scanned-row transition phase in driving the electroluminescence display. In this stage, current sources are applied toward the end of the transitional phase with anode line driving switches, for example switches 62 and 63, switched closed-circuited so as to connect anode lines, for example lines A2 and A3, to their respective current sources, for example sources 22 and 23. The driving system returns to the initial phase, i.e., the lighting phase, for a new row.

In one aspect, driving systems and methods for electroluminescence displays consistent with the present invention are effectively applicable to gray scale displays. In another aspect, driving systems and methods consistent with the present invention will also be applicable to color displays where each color pixel consists of color sub-pixels and the pixel color is controlled by the gray scales of the color sub-pixels. Depending on characteristics of the electroluminescence elements for the color components, individual gray scale driving systems for the color components generally include individually optimized sets of parameters and circuit options. For instance, if the CEB voltage levels for different color components are different, there will be separate CEB bus lines with separate regulated voltage drivers for the color components.

In another aspect, display systems consistent with the present invention can also include organic light emitting devices (OLEDs) or polymer electroluminescence devices (PELDs).

Gray scales are obtained by activating the anode lines for various time periods according to the gray scale display data in the time period for a single row of display time. For pulse width modulation (PWM), the longest duration corresponds to the highest brightness of a lighted element in the gray scale. Alternatively, gray scales can also be obtained by activating anode lines for various frames over a display period. For frame rate control, turning on an electroluminescence element at every frame corresponds to the highest brightness of a lighted element in the gray scale. In addition to frame rate control and PWM, amplitude modulation (AM) is also available for obtaining gray scales. For amplitude modulation control, the highest setting for the drive current corresponds to the highest brightness of a lighted element in the gray scale. In a general case, a combination of PWM, frame rate control and AM is applicable for gray scale imaging and column equalization can be implemented.

Depending on the implementation complexity and panel characteristics of the electroluminescence display, a variety of alternatives for implementing driving systems and methods consistent with the present invention can be practiced.

First, the activation and de-activation voltages for the anode and cathode lines, and the CEB voltages at various phases in driving the electroluminescence display can all be different from the system supply voltages and ground voltages, and be different during different driving phases, in order to achieve low power and low noise in the display system. For instance, when the circuit configuration allows de-activation of anode lines to be acceptable at a higher voltage than ground voltage, anode lines can be de-activated by connecting to a return bus or a different ground voltage other than the system voltage. The return bus or the return ground voltage can be maintained at an appropriate de-activation voltage level that can be programmable to suit the characteristics of the electroluminescence elements. Higher de-activation voltages have advantages of smaller differential voltage switching and smaller reverse bias across the electroluminescence elements. Another option is to use a lower voltage than the system high voltage supply for the inactive cathode lines. With smaller differential voltage switching, the switching power is advantageously reduced. With a smaller reverse bias across the electroluminescence elements, reverse bias stress and reliability risks are advantageously reduced.

An additional option is to use a separate CEB and voltage driving line, except that the columns are switched to the separate voltage driving line at the activation phase of lighting the electroluminescence elements. The voltage driving bus can then be maintained at a fixed voltage that can be stabilized by a capacitor. In such a case, the CEB does not need to be switched between the high pre-charge level and a lower CEB voltage level as a result.

Other embodiments of the invention will be apparent to those skilled in the art from consideration of the specification and practice of the invention disclosed herein. For instance, although general electroluminescence displays are described in illustrating the driving systems and methods according to the present invention, organic light emitting devices (OLEDs) and polymer electroluminescence devices (PELDs) are in general equally applicable. It is intended that the specification and examples be considered as exemplary only, with a true scope and spirit of the invention being indicated by the following claims.

We claim:

1. A display system comprising:

a matrix of electroluminescence elements arrayed in a plurality of rows and columns;

a plurality of cathodes and anodes corresponding to the electroluminescence elements;

a plurality of cathode lines electrically connected to the cathodes on the rows in the matrix;

a plurality of anode lines electrically connected to the anodes on the columns in the matrix, the anode lines including a first anode line and a second anode line;

a column equalization bus electrically connectable to the anode lines; and a control circuit to concurrently:

(i) electrically isolate the column equalization bus from any active power source, (ii) connect the first anode line to the column equalization bus, and (iii) connect the second anode line to a power source for a time period corresponding to grayscale or color display data, to light at least one of the electroluminescence elements connected to the second anode line for display, and, after the time period, disconnecting the second anode line from the power source and connecting the second anode line to the column equalization bus to share charge with the first anode line.

2. The system of claim 1 wherein the control circuit is coupled to dynamically control a bus voltage on the column equalization bus.

3. The system of claim 2 wherein the control circuit is coupled to maintain a selected level of the bus voltage during at least a driving phase.

4. The system of claim 2 wherein the control circuit is coupled to clamp the bus voltage below a selected level during at least a driving phase.

5. The system of claim 2 wherein the control circuit is coupled to float the bus voltage up to a selected level during at least a driving phase.

6. The system of claim 1 wherein the electroluminescence elements comprise one of organic light emitting devices and polymer electroluminescence devices.

7. A driving system for an electroluminescence display having a matrix of electroluminescence elements arrayed in a plurality of rows and columns and a plurality of cathodes and anodes corresponding to the electroluminescence elements, the driving system comprising:

a plurality of cathode lines electrically connected to the cathodes on the rows in the matrix;

a plurality of anode lines electrically connected to the anodes on the columns in the matrix, the anode lines including a first anode line and a second anode line;

a column equalization bus electrically connectable to the anode lines; and a control circuit to concurrently:

(i) electrically isolate the column equalization bus from any active power source, (ii) connect the first anode line to the column equalization bus, and (iii) connect the second anode line to a power source for a time period corresponding to grayscale or color display data, to light at least one of the electroluminescence elements connected to the second anode line for display, and, after the time period, disconnecting the second anode line from the power source and connecting the second anode line to the column equalization bus to share charge with the first anode line.

8. The system of claim 7 wherein the control circuit is coupled to dynamically control a bus voltage on the column equalization bus.

9. The system of claim 8 wherein the control circuit is coupled to maintain a selected level of the bus voltage during at least a driving phase.

10. The system of claim 8 wherein the control circuit is coupled to clamp the bus voltage below a selected level during at least a driving phase.

11. The system of claim 8 wherein the control circuit is coupled to float the bus voltage up to a selected level during at least a driving phase.

12. The system of claim 7 further comprising a regulated voltage driver connected to the column equalization bus.

13. A method for driving an electroluminescence display having a matrix of electroluminescence elements arrayed in a plurality of rows and columns, a plurality of cathodes and anodes corresponding to the electroluminescence elements, a plurality of cathode lines electrically connected to the cathodes on the rows in the matrix, a plurality of anode lines electrically connected to the anodes on the columns in the matrix, the anode lines including a first anode line and a second anode line, the method comprising:

concurrently, (i) electrically isolating a column equalization bus from any active power source, the column equalization bus being electrically connectable to the anode lines, (ii) connecting the first anode line to the column equalization bus, and (iii) connecting the second anode line to a power source for a time period corresponding to grayscale or color display data, to light at least one of the electroluminescence elements connected to the second anode line for display, and, after the time period, disconnecting the second anode line from the power source and connecting the second anode line to the column equalization bus to share charge with the first anode line.

14. The method of claim 13 further comprising sequentially scanning the cathode lines.

15. The method of claim 13 further comprising dynamically controlling a bus voltage on the column equalization bus.

16. The method of claim 15 further comprising maintaining a selected level of the bus voltage during at least a driving phase.

17. The method of claim 15 further comprising clamping the bus voltage below a selected level during at least a driving phase.

18. The method of claim 15 further comprising floating the bus voltage up to a selected level during at least a driving phase.

19. The method of claim 13 further comprising driving the display in a plurality of driving phases including a scanning phase, an equalization phase and a transition phase.

* * * * *